United States Patent [19]

Goda et al.

[11] Patent Number: 5,008,177

[45] Date of Patent: Apr. 16, 1991

[54] SILVER HALIDE PHOTOGRAPHIC MATERIALS

[75] Inventors: Kensuke Goda; Shigeru Ohno, both of Kanagawa, Japan

[73] Assignee: Fuji Photo Film Co., Ltd., Kanagawa, Japan

[21] Appl. No.: 282,164

[22] Filed: Dec. 9, 1988

[30] Foreign Application Priority Data

Dec. 9, 1987 [JP] Japan ..... 62-311421

[51] Int. Cl.[5] ..... G03C 1/12; G03C 1/30

[52] U.S. Cl. ..... 430/522; 430/567; 430/621; 430/623; 430/626

[58] Field of Search ..... 430/522, 621, 623, 626, 430/567

[56] References Cited

U.S. PATENT DOCUMENTS

| | | | |
|---|---|---|---|
| 3,989,528 | 11/1976 | Sugiyama et al. | 430/507 |
| 4,587,195 | 5/1986 | Ishikawa et al. | 430/521 |
| 4,623,616 | 11/1986 | Takada et al. | 430/626 |
| 4,640,890 | 2/1987 | Fujita et al. | 430/567 |
| 4,766,057 | 8/1988 | Sakai | 430/567 |
| 4,818,673 | 4/1989 | Ueda et al. | 430/556 |
| 4,837,140 | 6/1989 | Ikeda et al. | 430/567 |

FOREIGN PATENT DOCUMENTS

| | | |
|---|---|---|
| 50-145125 | 11/1975 | Japan . |
| 50-147712 | 11/1975 | Japan . |
| 52-20830 | 2/1977 | Japan . |
| 34533 | 2/1988 | Japan . |
| 1466836 | 3/1977 | United Kingdom . |
| 1553516 | 9/1979 | United Kingdom . |

*Primary Examiner*—Hoa Van Le

*Attorney, Agent, or Firm*—Sughrue, Mion, Zinn, Macpeak & Seas

[57] ABSTRACT

Disclosed is a gelatino-silver halide photographic material which contains a dye of the following formula (I), described in detail herein and at least one hardener.

(I)

The dye is decolored by photographic processing and does not exert any adverse influence on the photographic characteristics, especially the spectral sensitizability, of the photographic material. The material exhibits excellent storage stability and has a negligible moisture-dependency in exposure.

8 Claims, No Drawings

SILVER HALIDE PHOTOGRAPHIC MATERIALS

FIELD OF THE INVENTION

The present invention relates to silver halide photographic materials and, more precisely, to those which have excellent photographic characteristics as well as excellent (long term) storability before they are processed. In particular, it relates to printing color photographic materials.

BACKGROUND OF THE INVENTION

In silver halide photographic materials, the photographic emulsion layers or other layers are often colored for the purpose of absorbing a light of a particular wavelength range. The layers to be colored are often composed of a hydrophilic colloid, and therefore, a water-soluble dye is generally incorporated into the layer to color the same. The dyes used for the purpose are required to satisfy the following conditions.

(1) They have a pertinent light-absorbability in accordance with the purpose for using them.

(2) They are photochemically inactive. Precisely, they do not impart any chemically unfavorable influences to the properties of the silver halide photographic emulsion layers; for example, they do not cause lowering of sensitivity, fading of latent images or fogging in the photographic emulsion layers.

(3) They are decolored or are dissolved and removed during the photographic processing step so that they do not cause any harmful extra-coloration in the photographic materials processed.

Many efforts have been made by those skilled in the art to find dyes which satisfy these conditions. In particular, oxonolepyrazolone dyes have been intensively studied because they have been considered to satisfy the necessary characteristics. They are disclosed in British Patents 506,385, 1,177,429, 1,278,621, 1,311,884, 1,338,799, 1,385,371, 1,467,214, 1,433,102 and 1,553,516; JP-A-48-85130, JP-A-49-114420, JP-A-55-161233 and JP-A-59-111640 (the term "JP-A" as used herein means an unexamined published Japanese patent application); and U.S. Pat. Nos. 3,247,127, 3,469,985, 4,078,933, 2,533,472 and 3,379,533.

However, some of these dyes are known to have drawbacks that they have a noticeable influence on spectrally sensitized emulsions in that they cause further spectral sensitization of the emulsions in the unnecessary range or they often cause desorption of sensitizing dyes thereby lowering the sensitivity of photographic emulsions, although they do not have so much influence on photographic emulsions themselves.

In addition, some of these dyes have been found to remain in the processed photographic materials after the materials are processed by rapid processing method which is frequently been utilized. In order to overcome these problems, use of dyes having a high reactivity with sulfite ion has been proposed. In such case, however, the stability of the dyes in a photographic film is not sufficient so that the concentration of the dyes therein decreases with time and, as a result, the desired photographic effect are not obtained. Accordingly, the dyes are unsatisfactory for photographic use.

On the other hand, in printing color photographic materials, gelatin is mostly related to the binder used in the materials, and a hardening agent for the binder is incorporated into the material together with the binder.

The characteristics required for the hardening agents include a rapid hardening activity, not causing fogging, etc. on silver halides, causing no problems related to sanitary labour conditions or any environmental pollution, good water solubility, easiness of synthesis and low cost.

Under the circumstances, investigation of printing color photographic materials has begun from the side of hardening agents of vinylsulfone compounds, ethyleneimine compounds, epoxy compounds, N-methylol compounds and cyanuric chloride compounds. In particular, the cyanuric chloride hardening agents described in JP-B-47-6151 (the term "JP-B" as used herein means an "examined Japanese patent publication), and JP-A-48-19220, JP-A-51-78788, JP-A-52-128130, JP-A-52-130326 and JP-A-56-1043 were found to satisfy almost all the aforesaid characteristics and were therefore considered excellent.

However, when silver halide photographic materials contain both an anti-irradiation dye and a hardening agent, two problems occur. One is that the solubility of the anti-irradiation dye in development decreases in some cases, depending upon the characteristics of the coexisting hardening agent, so that the whiteness in the non-image background part is also lowered. The second is that the combination of anti-irradiation dye and hardening agent would cause an advise influence of photographic characteristics of the photographic materials, such as desensitization or increase of fog, during storage of from preparation to use of the materials. Accordingly, it has been difficult to maintain the initial photographic characteristics of photographic materials during or after storage of the materials.

SUMMARY OF THE INVENTION

A first object of the present invention is to provide a silver halide photographic material in which a hydrophilic colloid layer has been dyed with a water soluble dye which does not exert any harmful influence on the photographic characteristics of the silver halide emulsion layer.

A second object of the present invention is to provide a silver halide photographic material in which a hydrophilic colloid layer has been dyed with a watersoluble dye which may easily be decolored by photographic processing.

A third object of the present invention is to provide a silver halide photographic material whose photographic properties exhibit substantially no variation even after the material has been stored for a long period of time.

It has been found that these objects may be achieved by a gelatino-silver halide photographic material which contains a compound represented by formula (I) on a support and which is hardened with a compound represented by formula (II) and/or a compound represented by formula (III):

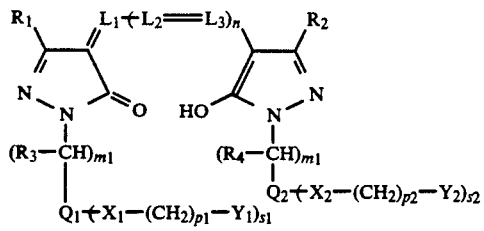

(I)

where $R_1$ and $R_2$ each independently represents $-COOR_5$ or

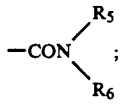

$R_3$ and $R_4$ each independently represents a hydrogen atom or an alkyl group;

$R_5$ and $R_6$ each independently represents a hydrogen atom, an alkyl group or an aryl group;

$Q_1$ and $Q_2$ each independently represents an aryl group;

$X_1$ and $X_2$ each independently represents a divalent linking group or a bond;

$Y_1$ and $Y_2$ each independently represents a sulfo group or a carboxyl group;

$L_1$, $L_2$ and $L_3$ each independently represents a methine group;

$m_1$ and $m_2$ each independently represents 1 or 2;

n represents 0, 1 or 2;

$_1$ and $p_2$ each independently represents 0, 1, 2, 3 or 4; and $s_1$ and $s_2$ each independently represents 1 or 2;

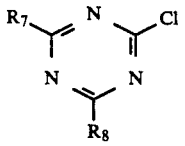

(II)

where $R_7$ represents a chlorine atom, a hydroxyl group, an alkyl group, an alkoxy group, an alkylthio group, —OM (in which M is a monovalent metal atom), Or $-NR^IR^{II}$ or $-NHCOR^{III}$ (in which $R^I$, $R^{II}$ and $R^{III}$ are each independently a hydrogen atom, an alkyl group or an aryl group); and $R_8$ the same meaning as $R_7$ except that it cannot represent a chlorine atom;

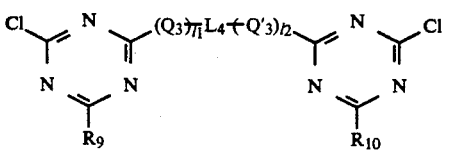

(III)

where $R_9$ and $R_{10}$ each independently represents a chlorine atom, a hydroxyl group, an alkyl group, an alkoxy group or —OM (in which M is a monovalent metal atom); $Q_3$ and $Q_3'$ each independently represents a linking group represented by —O—, —S— or —NH—;

$L_4$ represents an alkylene group or an arylene group; and $l_1$ and $l_2$ each independently represents 0 or 1.

DETAILED DESCRIPTION OF THE INVENTION

In formula (I), $R_3$ and $R_4$ each is preferably a hydrogen atom or a methyl group; $R_5$ and $R_6$ each is preferably a hydrogen atom, an alkyl group having 4 or less carbon atoms, a substituted alkyl group having 6 or less carbon atoms (where the substituent is preferably selected from a sulfo group, a carboxyl group, a hydroxyl group, an alkoxy group having 2 or less carbon atoms, a chlorine atom, a cyano group, an amino group and an alkylamino group having 4 or less carbon atoms), a phenyl group, a substituted phenyl group (where the substituent is preferably selected from a sulfo group, a carboxyl group, an alkoxy group having 4 or less carbon atoms, a chlorine atom, a cyano group, an alkyl group having 4 or less carbon atoms, an amino group and an alkylamino group having 4 or less carbon atoms). Alternatively, $R_5$ and $R_6$ may together form a 5-membered or 6-membered ring (e.g., a morpholino ring, a pyrrolidine ring, a piperidine ring).

$Q_1$ and $Q_2$ each is preferably a phenyl group or a substituted phenyl group in which the substituent is preferably selected from an alkyl group having 4 or less carbon atoms, an alkoxy group having 4 or less carbon atoms, a halogen atom (e.g., chlorine, bromine, fluorine) and a dialkylamino group having 4 or less carbon atoms. $X_1$ and $X_2$ each is preferably —O—,

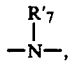

or a bond, and $R'_7$ is preferably a hydrogen atom, an alkyl group having 5 or less carbon atoms or a substituted alkyl group having 5 or less carbon atoms in which the substituent is selected from an alkoxy group having 3 or less carbon atoms, a cyano group, a hydroxyl group and an alkylamino group having 4 or less carbon atoms.

The carbon number range of the substituent for the compound represented by formula (I) is preferably selected from such carbon number ranges that the water-solubility of the compound is not prevented. Also, the substituent is not preferably absorbed by silver halide or silver.

Among the dyes of the formula (I), those where $m_1=m_2=_1$ are more preferred.

Specific examples of the dyes represented by formula (I) are illustrated below, which, however, are not limitative.

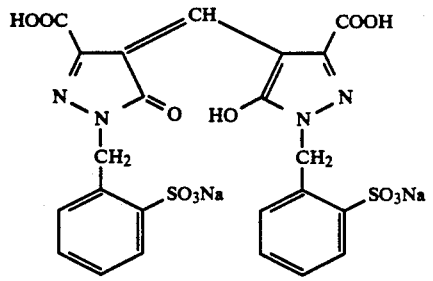
I-1
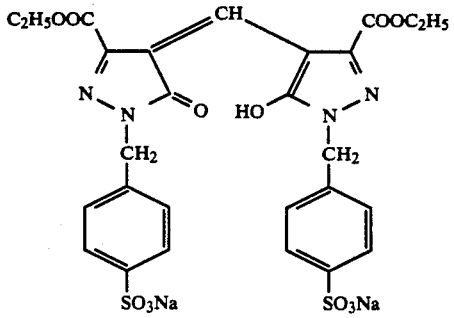
I-2
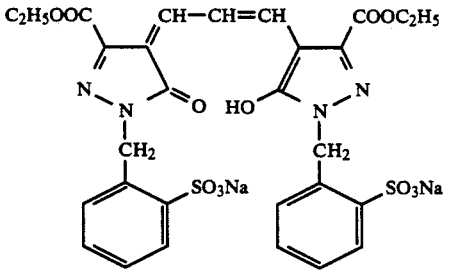
I-3
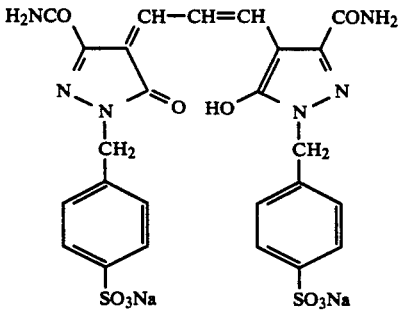
I-4
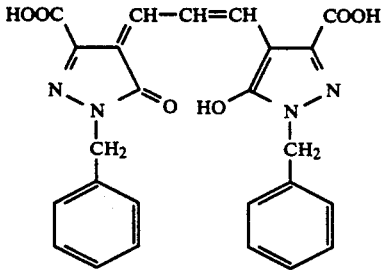
I-5

-continued
I-6
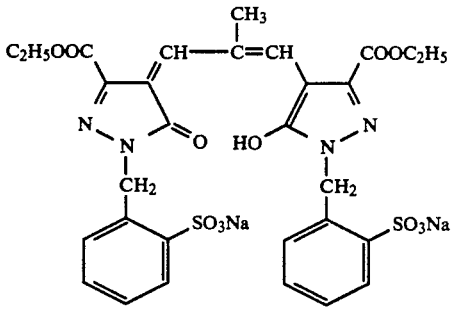
I-7
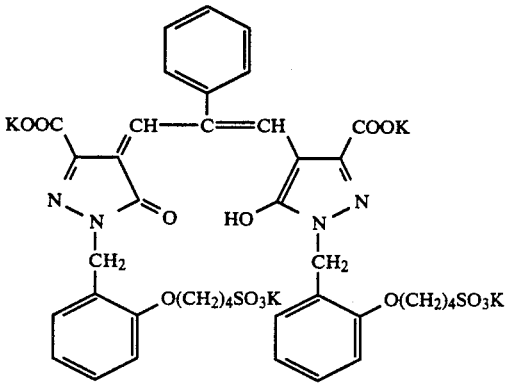
I-8
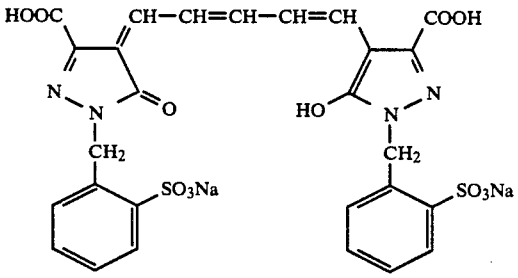
I-9
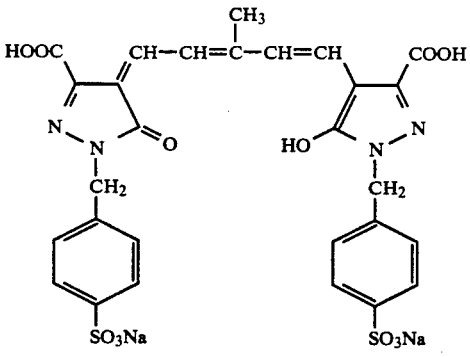
I-10
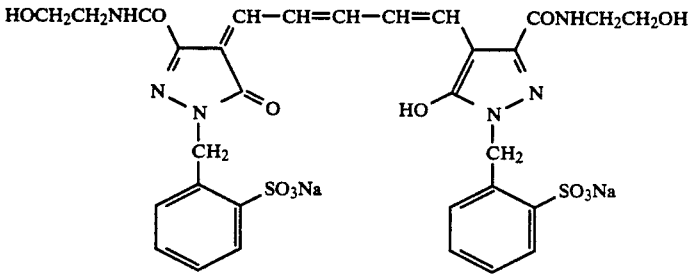

-continued
I-11
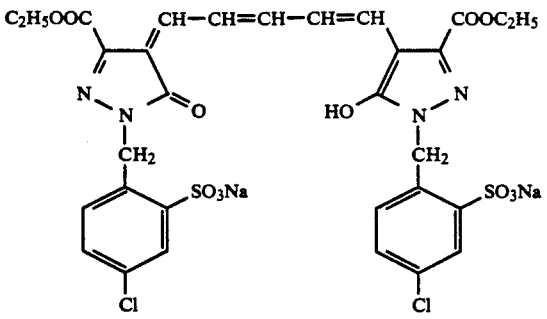
I-12
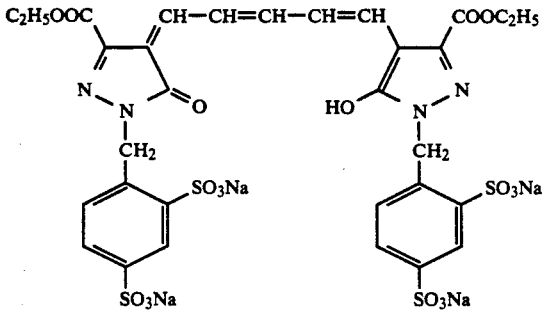
I-13
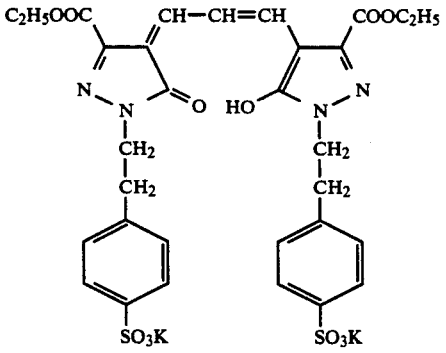
I-14
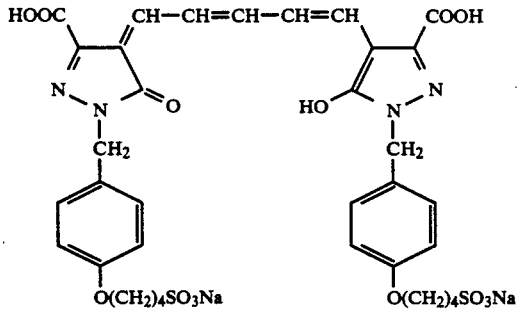
I-15
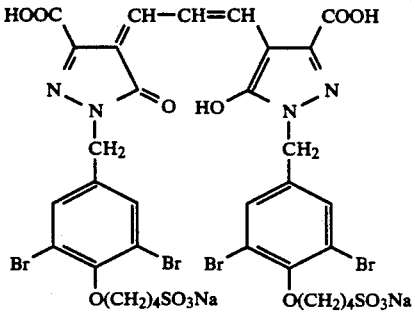

-continued
I-16
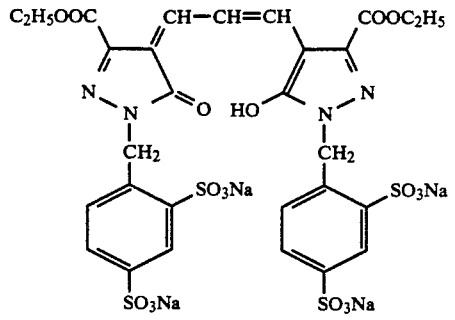
I-17
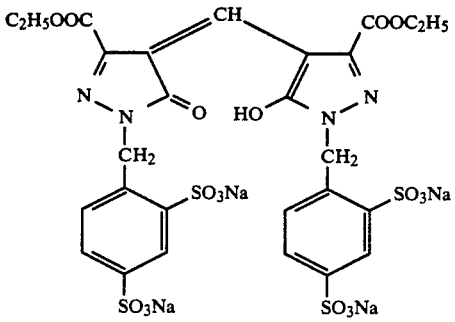
I-18
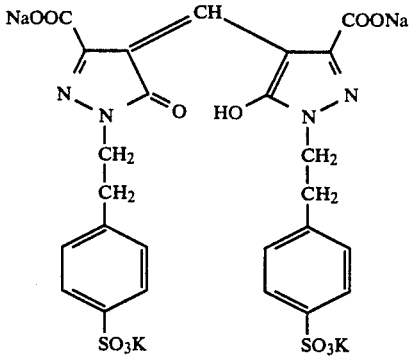
I-19
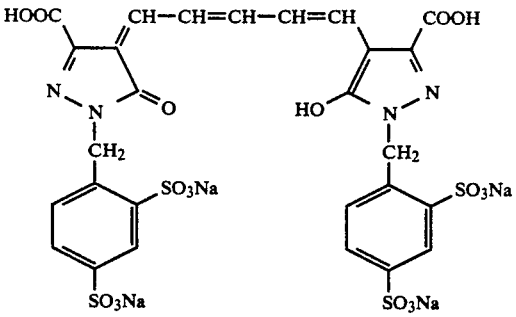
I-20
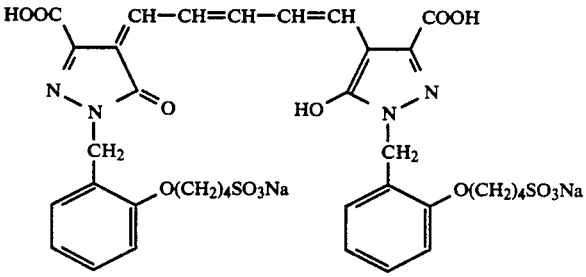

-continued
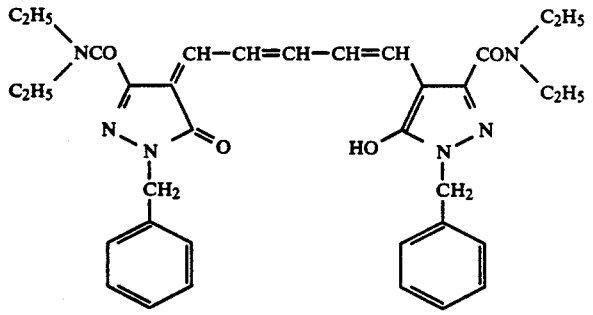
I-21
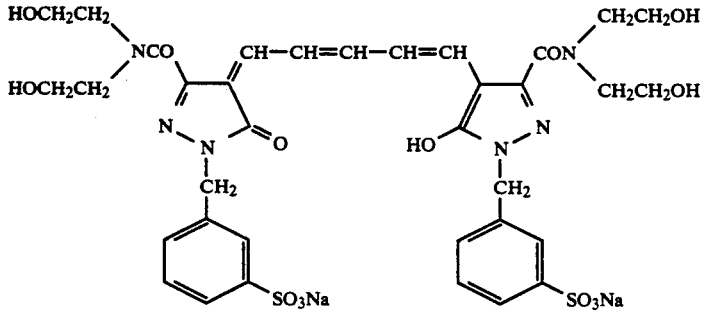
I-22
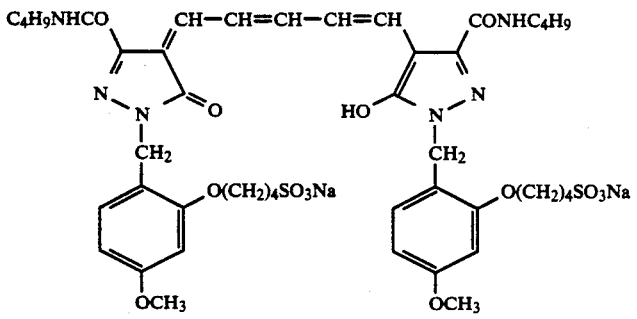
I-23
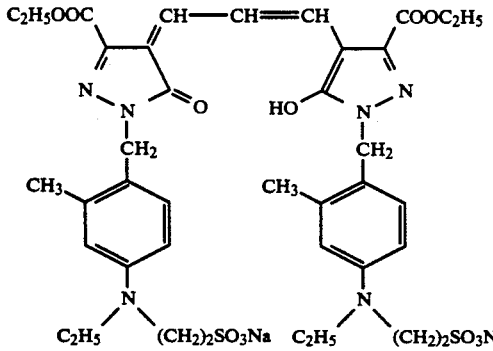
I-24
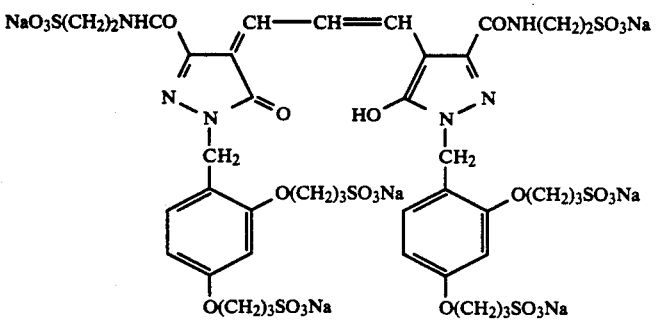
I-25

-continued
I-26
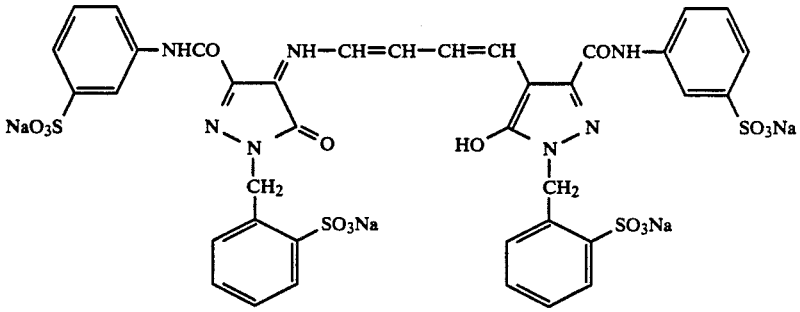
I-27
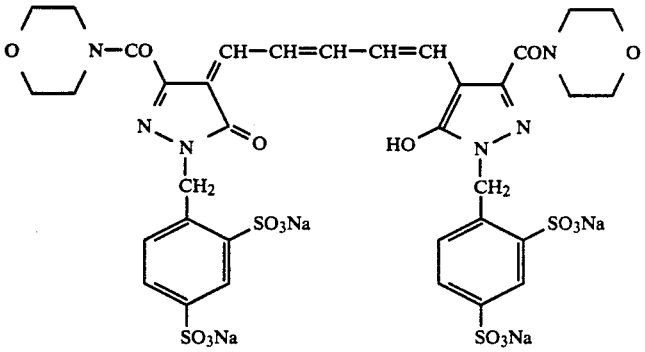
I-28
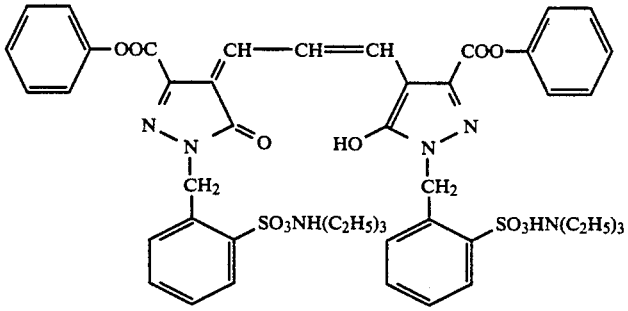
I-29
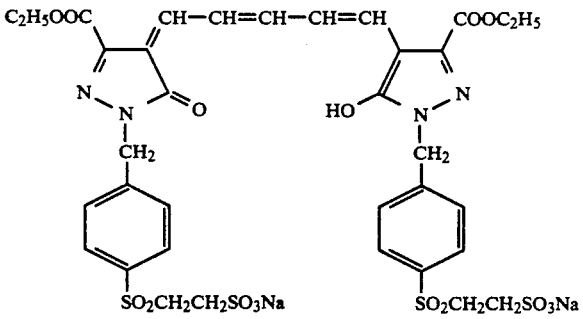
I-30
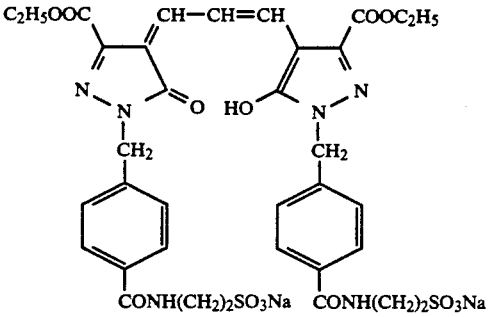

-continued
I-31
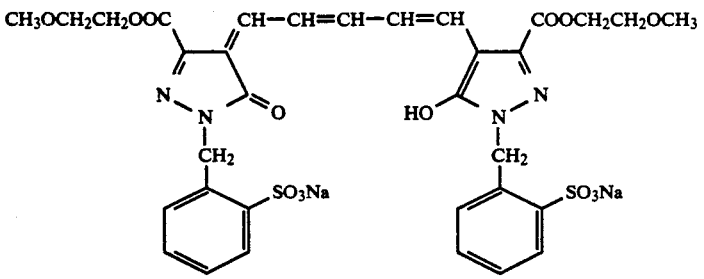
I-32
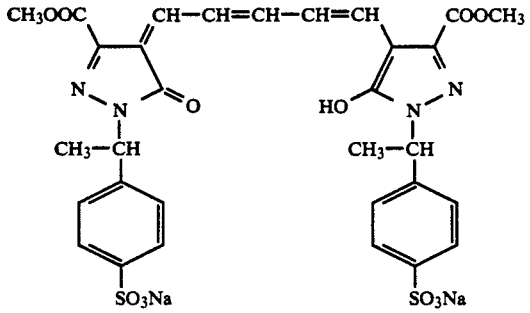
I-33
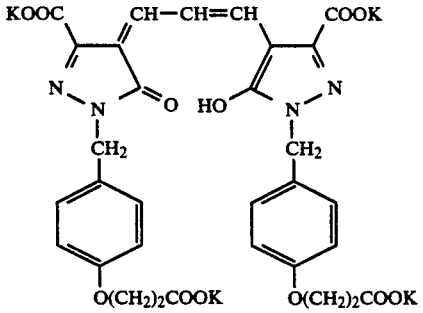
I-34
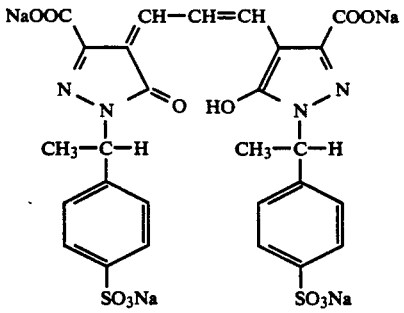
I-35
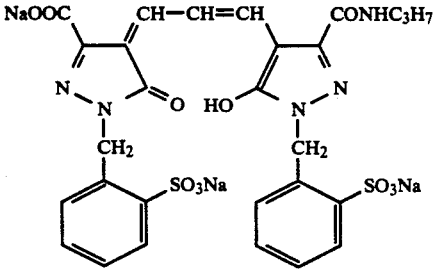

-continued
I-36
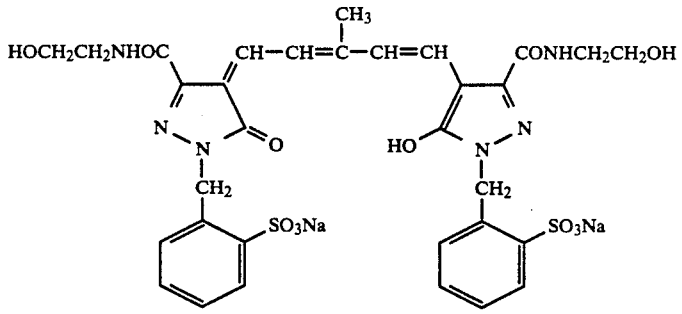
I-37
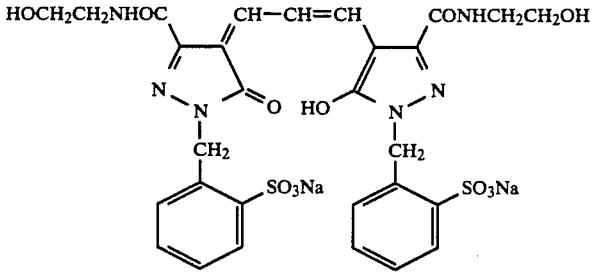
I-38
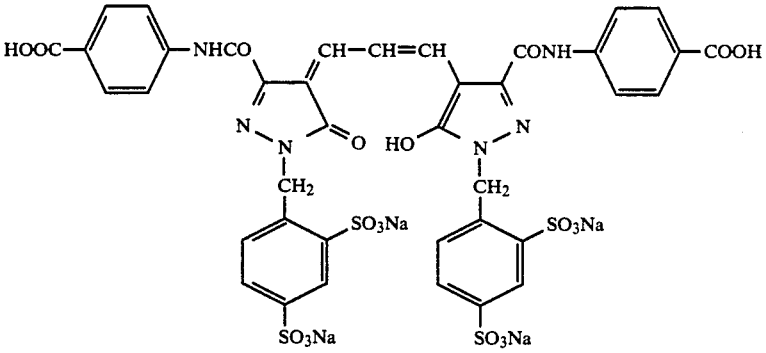
I-39
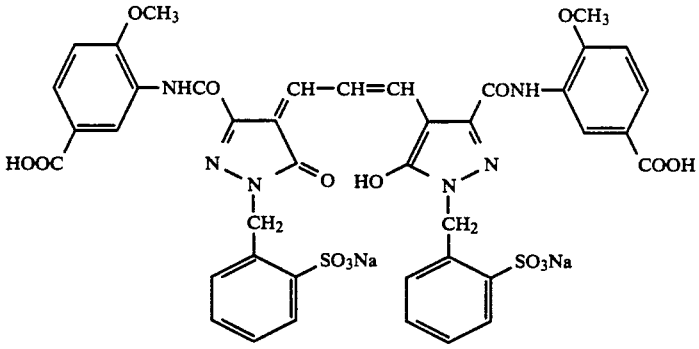
I-40
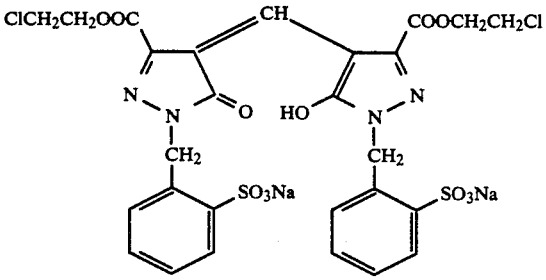

-continued
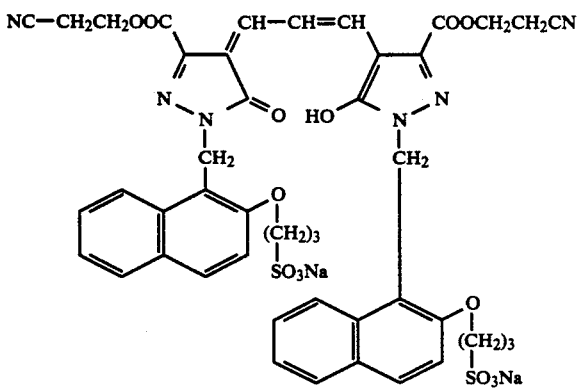
I-41
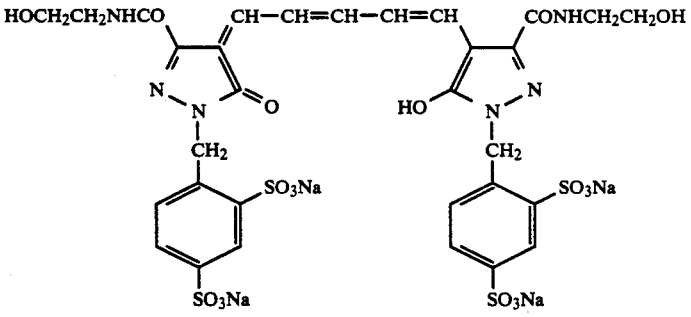
I-42
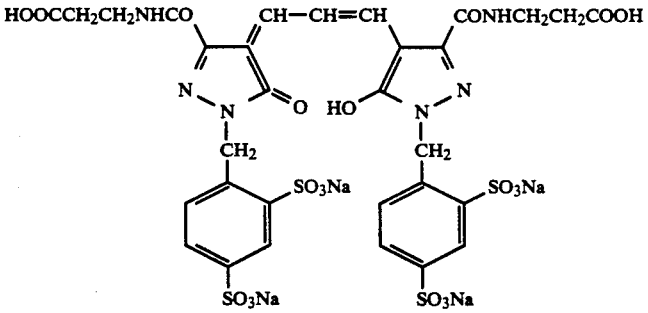
I-43
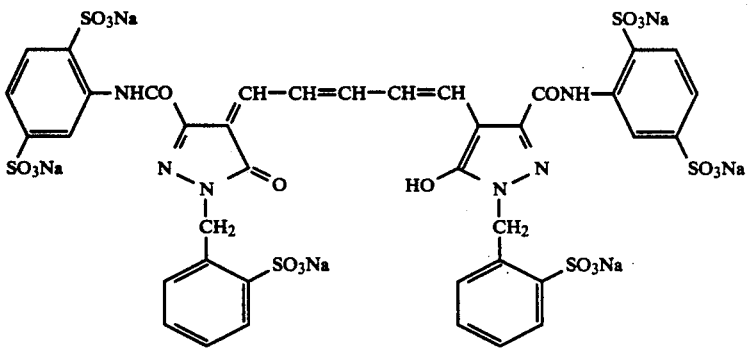
I-44

-continued
I-45
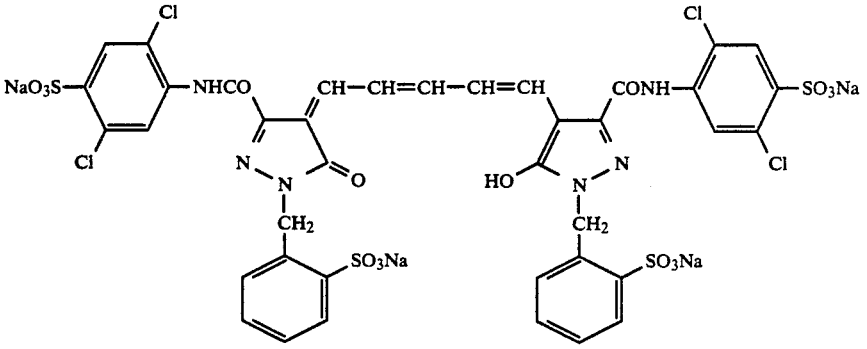
I-46
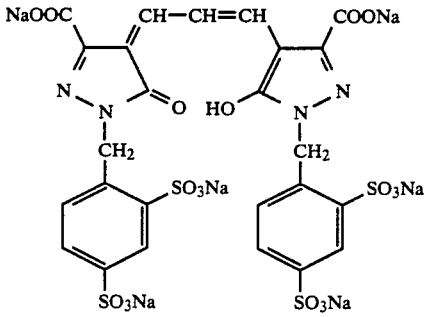
I-47
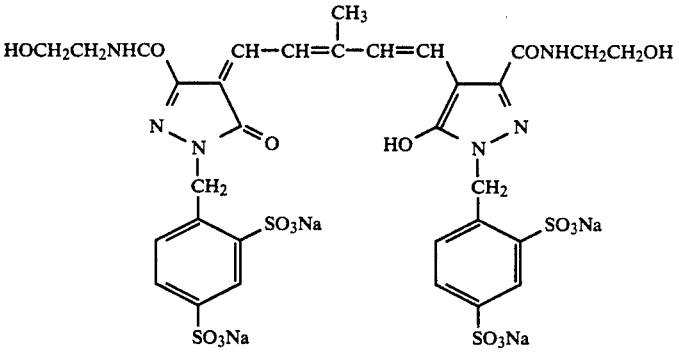
I-48
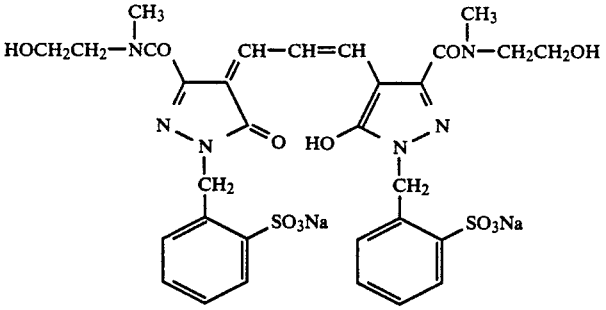
I-49
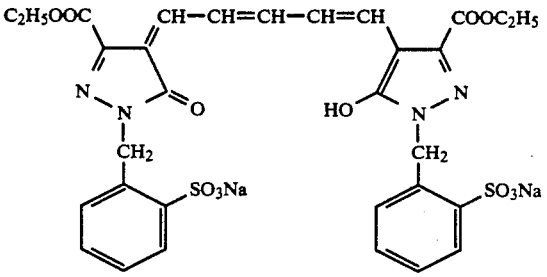

-continued

I-50

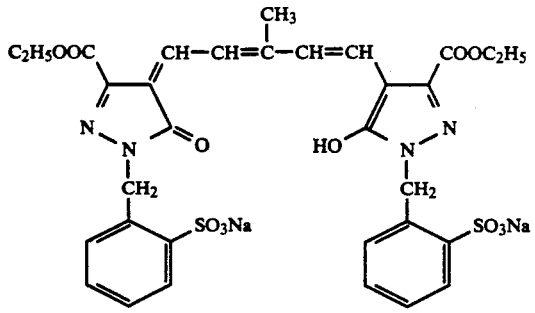

I-51

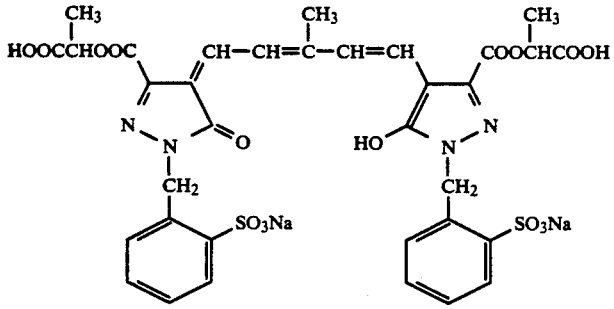

The dyes of formula (I) for use in the present invention can be added to an optional coating solution to be coated on the same side of support as that where a silver halide emulsion layer is coated, in the form of aqueous solution or alcoholic solution (such as methanolic solution). The addition amount of the dyes is not particularly limited, but it is suitably within the range of from about $1\times10^{-7}$ mol/m$^2$ to about $1\times10^{-3}$ mol/m$^2$, preferably from about $1\times10^{-6}$ mol/m$^2$ to about $1\times10^{-4}$ mol/m$^2$. The optical density of the dyes after coating is preferably within the range of from about 0.05 about 3.0.

The alkyl group represented by $R_7$ and $R_8$ in formula (II) includes, for example, methyl, ethyl and butyl groups; and the alkoxy group includes methoxy, ethoxy and butoxy groups. M in the group —OM for $R_7$ and $R_8$ is, for example, a sodium or potassium atom.

The cyanuric chloride hardening agents of formula (II) are mentioned in U.S. Pat, No. 3,645,743; JP-B-47-6151, JP-B-47-33380 and JP-B-51-9607; JP-A-48-19220, JP-A-51-78788, JP-A-52-60612, JP-A-52-128130, JP-A-52-130326 and JP-A-56-1043; compounds may be selected therefrom for use in the present invention in accordance with the above-mentioned criteria.

The alkyl group for $R_9$ and $R_{10}$ in formula (III) includes, for example, methyl, ethyl and butyl groups; the alkoxy group includes methoxy, ethoxy and butoxy groups. M in the group —OM is, for example, a sodium or potassium atom.

The alkylene group for $L_4$ includes, for example, methylene, ethylene and propylene groups; the arylene group includes, for example, p-, o- and m-phenylene groups.

The cyanuric chloride hardening agents of formula (III) are mentioned in Canadian Patent 895,808, JP-B-58-33542 and JP-A-57-40244; compounds may be selected therefrom for use in the present invention in accordance with the above-mentioned criteria.

Since the compounds of formulae (II) and (III) for use in the present invention may diffuse throughout the all photographic layers as coated, the compounds may be added to one layer, or plural layers selected from the emulsion layers and auxiliary layers of photographic materials. For addition of the compounds, the compounds are first dissolved in water or an alcohol (e.g., methyl alcohol, ethyl alcohol) and the resulting solution is added to a coating composition in an amount of from about 1 to about 100 mg, preferably from about 5 to about 50 mg, per g of gelatin in the composition. The addition method may be either a batch system or an in-line system, but the inline system is preferred.

Specific examples of compounds represented by formulae (II) and (III) are mentioned below, which, however, are not limitative.

EXAMPLES OF COMPOUNDS OF FORMULA (II)

(II-1)

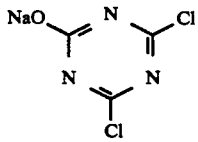

(II-2)

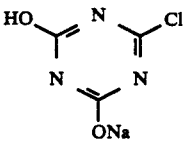

(II-3)

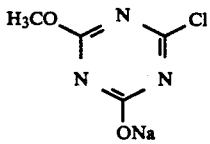

(II-4)

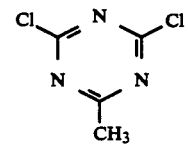

(II-5)

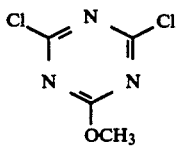

(II-6)

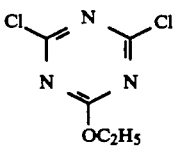

-continued (II-7)

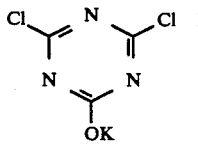

(II-8)

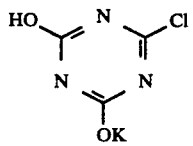

(II-9)

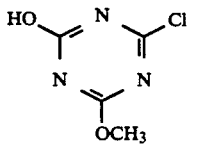

(II-10)

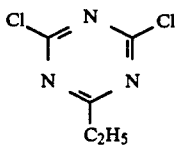

(II-11)

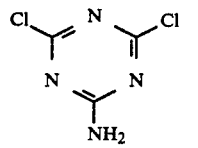

(II-12)

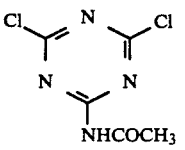

(II-13)

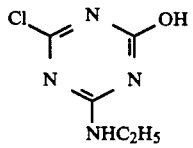

EXAMPLES OF COMPOUNDS OF FORMULA (III)

(III-1)

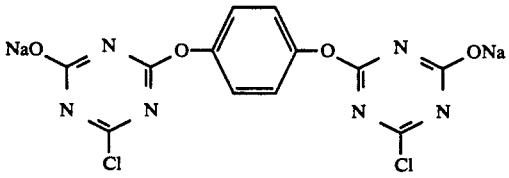

(III-2)

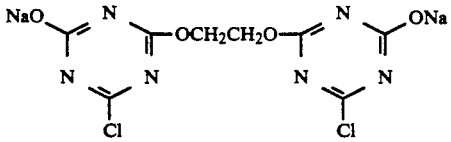

(III-3)

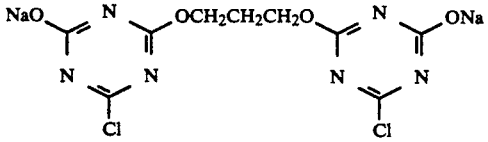

(III-4)

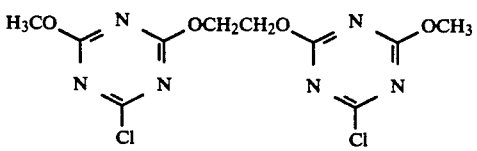

-continued (III-5)

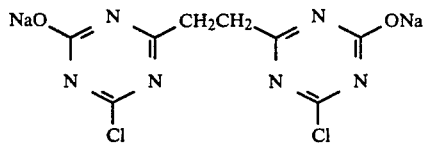

(III-6)

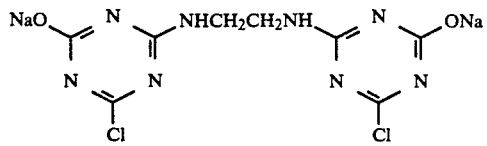

(III-7)

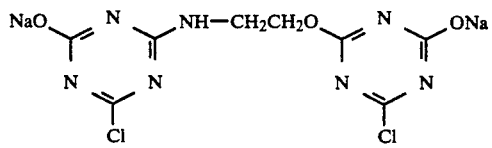

(III-8)

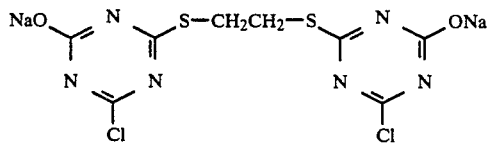

(III-9)

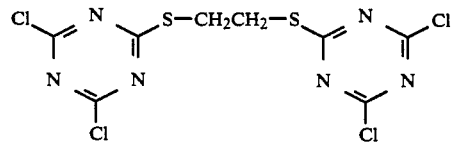

(III-10)

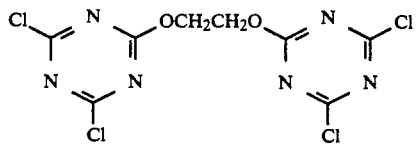

For the silver halide emulsion used in the present invention, silver bromide, silver iodobromide, silver iodochlorobromide, silver chlorobromide and silver chloride are preferred. It is most preferred that a silver chlorobromide emulsion has an average silver chloride content ranging from 90 to 99.8 mol %.

The silver halide grains for use in the present invention may be regular crystals such as cubic or octahedral crystals or irregular crystals such as spherical or tabular crystals, or may be a composite form of these crystals. Further, a mixture of grains of various crystal forms can be used, but the regular crystal grains can preferably be used.

The silver halide grains for use in the present invention may have different phases in the interior part and the surface layer thereof, or they may have a uniform phase throughout the complete grain. Grains which may form a latent image mainly on the surface part (for example, negative type emulsion) are preferred, but grains which form a latent image mainly in the inside part (for example, internal latent image emulsion, prefogged direct reversal emulsion) may also be used.

The silver halide emulsion for use in the present invention is preferably a tabular grain emulsion in which the grains have an aspect ratio of about 5 or more, preferably about 5 to about 8, but they have the aspect ratio of more than 8, or a monodisperse emulsion in which coefficient of variation of grain size is about 20% or less (i.e., 0.20 or less), preferably about 15% or less (i.e., 0.15 or less), more preferably about 10% or less (i.e., 0.10 or less). The tabular grain emulsion and monodisperse emulsion may be blended together for use in the present invention.

The photographic emulsion for use in the present invention may be prepared by the methods described in P. Glafkides, *Chimie et Physique Photographegue* (published by Paul Montel, 1967); G.F. Duffin, *Photographic Emulsion Chemistry* (published by Focal Press, 1966); V.L. Zelikman et al, *Making and Coating Photographic Emulsion* (published by Focal Press, 1964) etc.

The silver halide grains may be formed in the presence of a silver halide solvent for controlling the growth of the grains, the solvent including, for example, ammonia, potassium thiocyanate, ammonium thiocyanate, thioether compounds (for example, those described in U.S. Pat. Nos. 3,271,157, 3,574,628, 3,704,130, 4,297,439 and 4,276,374), thione compounds (for example, those described in JP-A-53144319, JP-A-53-82408 and JP-A-55-77737), amine compounds (for example, those described in JP-A-54-100717) and so on.

The silver halide grains may also be formed or physically ripened in the presence of a cadmium salt, a zinc salt, a thallium salt, an iridium salt or a complex salt thereof, a rhodium salt or a complex salt thereof, or an iron salt or a complex salt thereof.

The silver halide emulsion for use in the present invention is generally chemically sensitized. For chemical sensitization, for example, the methods described in H. Frieser, Die Grundlagen der Photographischen Prozesse mit Silberhalogeniden (Akademische Verlags Geselschaft, 1968), pages 675 to 734, may be employed.

Briefly, a sulfur sensitization method of using an active gelatin or a sulfur-containing compound capable of reacting with silver (for example, thiosulfates, thioureas, mercapto compounds, rhodanines); a reduction sensitization method of using a reducing substance (for example, stannous salts, amines, hydrazine derivatives, formamidinesulfinic acids, silane compounds); or a noble metal sensitization method of using a noble metal (for example, gold complexes as well as complexes of metals of Group VIII of the Periodic Table, such as Pt, Ir or Pd) may be employed singly or in combination of the methods.

The silver halide photographic emulsions for use in the present invention may contain various compounds for the purpose of preventing the photographic materials from being fogged during preparation, storage or photographic processing of the materials or for the purpose of stabilizing the photographic properties of the materials. For example, various kinds of compounds which are known as an anti-foggant or stabilizer can be added to the photographic emulsions for use in the present invention, and examples of the compounds include azoles such as benzothiazolium salts, nitroindazoles, triazoles, benzotriazoles, benzimidazoles (especially, nitro- or halogen-substituted compounds); heterocyclic mercapto compounds such as mercaptothiazoles, mercaptobenzothiazoles, mercaptobenzimidazoles, mercaptothiadiazoles, mercaptotetrazoles (especially, 1-phenyl-5-mercaptotetrazole); mercaptopyrimidines; the heterocyclic mercapto compounds having a water-soluble group such as a carboxyl or sulfone group; thioketo compounds such as oxazolinethione; azaindenes such as tetrazaindenes (especially, 4-hydroxy-substituted (1,3,3*a*,7)tetrazaindenes); benzenethiosulfonic acids; and benzenesulfinic acids.

The silver halide photographic emulsions for use in the present invention can contain color couplers such as cyan coupler, magenta coupler and yellow coupler as well as compounds for dispersing such couplers That is, the emulsions may contain compounds which may color by oxidation coupling with an aromatic primary amine developing agent (for example, phenylenediamine derivatives or aminophenol derivatives) in color development. Precisely, magenta couplers which may be used in the present invention include 5-pyrazolone couplers, pyrazolobenzimidazole couplers, cyanoacetylcoumarone couplers, pyrazolotriazole couplers and open-chain acylacetonitrile couplers; yellow couplers include acylacetamide couplers (for example, benzoylacetanilides, pivaloylacetanilides); and cyan couplers include naphthol couplers and phenol couplers. These couplers are preferred to be non-diffusible, because of having a hydrophobic group which is called a ballast group in the molecule The couplers may be either 4-equivalent or 2-equivalent to silver ion. In addition, colored couplers having a color-correcting activity as well as couplers capable of releasing a development inhibitor with development (so-called DIR couplers) may also be incorporated into the photographic emulsions for use in the present invention.

In addition to such DIR couplers, the emulsions may also contain colorless DIR coupling compounds which may form a colorless product and release a developing inhibitor by coupling reaction.

The photographic emulsions for use in the present invention may further contain, for example, polyalkyleneoxides or the ether, ester or amine derivatives thereof, thioether compounds, thiomorpholines, quaternary ammonium compounds, urethane derivatives, urea derivatives, imidazole derivatives or 3-pyrazolidones, for the purpose of increasing the sensitivity and the contrast and of enhancing the developability.

The silver halide photographic emulsions for use in the present invention may further contain known water-soluble dyes, in addition to the particular dyes of the present invention which have been specifically defined hereinabove, for example, oxonole dyes, hemioxonole dyes or merocyanine dyes, as a filter dye or for the purpose of anti-irradiation or other various purposes. Further, the emulsions may also contain known cyanine dyes, merocyanine dyes or hemicyanine dyes, as a spectral sensitizer.

The photographic emulsions for use in the present invention may contain various surfactants for various purposes of coating aid, static charge prevention, improvement of slide property, emulsification and dispersion, surface blocking prevention and improvement of photographic characteristics (e.g., developability, hard contrast and sensitivity).

The photographic materials of the present invention may contain anti-fading agents, color-fogging inhibitors, ultraviolet absorbents, protective colloids such as gelatin as well as various additives, which are described in *Research Disclosure*, Vol 176 (1987, XII) RD-17643.

The finished emulsion is coated on a proper support, such as baryta paper, resin-coated paper, synthetic paper, triacetate film, polyethylene terephthalate film and other various plastic bases or glass plate, for preparing the photographic materials of the present invention.

For photographic processing of the photographic materials of the present invention, any and every known method and known processing solutions, for example, those described in *Research Disclosure*, Vol. 176, pages 28 to 30 (RD-17643) may be employed. The photographic processing for the photographic materials of the present invention may be either black-and-white photographic processing for forming silver images or color photographic processing for forming dye images.

The color photographic processing method is not specifically limited but any and every method may be applied to the materials of the present invention. Briefly, after being exposed, the materials are developed and bleach-fixed or fixed and then generally subjected to rinsing in water or stabilization.

In the rinsing-in-water step, two or more rinsing tanks are generally used under a countercurrent flow system for economization of the rinsing water to be used. In place of the rinsing-in-water step, stabilization may be carried out, and the multistage countercurrent stabilization described in JP-A-57-8543 is one typical example. In the stabilization step, from 2 to 9 countercurrent bathes are required. Various kinds of compounds may be added to the stabilization bath for the purpose of stabilizing the images formed in the photographic material processed. For example, as typical examples of the additives to the stabilization bath, there are various kinds of buffer for adjusting the film pH (for example, pH 3 to 8) and formaldehyde. The buffers include, for example, boric acid salts, metaboric acid salts, borax phosphoric acid salts, carbonic acid salts, potassium hydroxide, sodium hydroxide, aqueous ammonia, monocarboxylic acids, dicarboxylic acids and polycarboxylic acids, which may be used in combination. In addition, other various kinds of additives, such as a water softener (e.g., inorganic phosphoric acids, aminopolycarboxylic acids, organic phosphoric acids, aminopolyphosphonic acids, phosphonocarboxylic acids), a microbicide (e.g., benzoisothiazolinone, isothiazolone, 4-thiazolinebenzimidazole, halogenated phenols), a surfactant, a brightening agent and a hardening agent, may also be added to the stabilization bath. Two or more compounds each having the same or different activities may be used together.

As a pH adjusting agent for the photographic materials processed, various kinds of ammonium salts, such as ammonium chloride, ammonium nitrate, ammonium sulfate, ammonium phosphate, ammonium sulfite or ammonium thiosulfate, are preferably added to the stabilization bath.

Any and every color photographic processing in which a color developer is used may be applied to the photographic materials of the present invention The present invention may be applied to color papers, color reversal papers, color positive films, color negative films and color reversal films.

The following examples are intended to illustrate the present invention in more detail but not to limit it in any way. Unless indicated otherwise, all parts, percents, ratios etc. are by weight.

EXAMPLE 1

The layers each having the composition mentioned below were formed on a paper support both surfaces of which were coated with polyethylene, to prepare a printing multilayer color photographic material sample having the layer constitution mentioned below.

LAYER CONSTITUTION

The compositions of the respective constitutional layers are mentioned below. The figure for the component means the amount coated, as represented by the unit of g/m$^2$. The amount of silver halide emulsion is represented by the unit of g/m$^2$ as silver coated.

| | |
|---|---|
| Support: | |
| Polyethylene Laminated Paper (containing white pigment ($TiO_2$) and blueish dye (ultramarine) in polyethylene on the side of the first layer). | |
| First Layer: Blue-sensitive Silver Halide Emulsion Layer | |
| Silver Halide Emulsion (mean grain size 0.96 μm; coefficient of variation 5.6%; Br 80%) | 0.16 |
| Silver Halide Emulsion (mean grain size 0.64 μm; coefficient of variation 6.9%; Br 80%) | 0.10 |
| Spectral Sensitizer (Sen-1) | 0.0010 |
| Antifoggant (Cpd-1) | 0.004 |
| Gelatin | 1.83 |
| Yellow Coupler (ExY) | 0.83 |
| Color Image Stabilizer (Cpd-2) | 0.19 |
| Solvent (Solv-1) | 0.35 |
| Second Layer: Color Mixing Preventing Layer | |
| Gelatin | 0.99 |
| Color Mixing Preventing Agent (Cpd-3) | 0.08 |
| Third Layer: Green-sensitive Silver Halide Emulsion Layer | |
| Silver Halide Emulsion (mean grain size 0.52 μm; coefficient of variation 8.0%; Br 70%) | 0.05 |
| Silver Halide Emulsion (mean grain size 0.39 μm; coefficient of variation 8.5%; Br 70%) | 0.11 |
| Spectral Sensitizing Agent (Sen-2-1) | 0.00017 |
| Spectral Sensitizing Agent (Sen-2-2) | 0.00003 |
| Antifoggant (Cpd-4) | 0.001 |
| Gelatin | 1.79 |
| Magenta Coupler (ExM) | 0.32 |
| Color Image Stabilizer (Cpd-5) | 0.20 |
| Solvent (Solv-2) | 0.65 |
| Fourth Layer: Ultraviolet Absorbing Layer | |
| Gelatin | 1.58 |
| Ultraviolet Absorbent (UV) | 0.62 |
| Color Mixing Preventing Agent (Cpd-6) | 0.05 |
| Solvent (Solv-3) | 0.24 |
| Dye (see Table 1) | |
| Fifth Layer: Red-sensitive Silver Halide Emulsion Layer | |
| Silver Halide Emulsion (mean grain size 0.44 μm; coefficient of variation 9.8%; Br 70%) | 0.07 |
| Silver Halide Emulsion (mean grain size 0.36 μm; coefficient of variation 7.8%; Br 70%) | 0.16 |
| Spectral Sensitizer (Sen-3) | 0.0001 |
| Antifoggant (Cpd-7) | 0.0001 |
| Gelatin | 1.34 |
| Cyan Coupler (ExC) | 0.34 |
| Color Image Stabilizer (Cpd-8) | 0.17 |
| Polymer (Cpd-9) | 0.40 |
| Solvent (Solv-4) | 0.23 |
| Sixth Layer: Ultraviolet Absorbing Layer | |
| Gelatin | 0.53 |
| Ultraviolet Absorbent (UV) | 0.21 |
| Solvent (Solv-3) | 0.08 |
| Hardening Agent (see Table 1) | |
| Seventh Layer: Protective Layer | |
| Gelatin | 1.33 |
| Acryl-modified Copolymer of Polyvinyl Alcohol (modification degree 17%) | 0.17 |
| Liquid Paraffin | 0.03 |

The compounds used in the above-mentioned layer compositions are as follows:

(Sen-1)
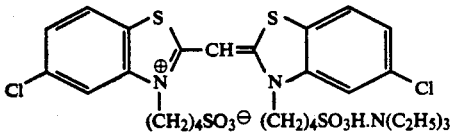
(Cpd-1)
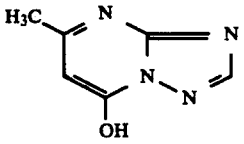
(ExY)
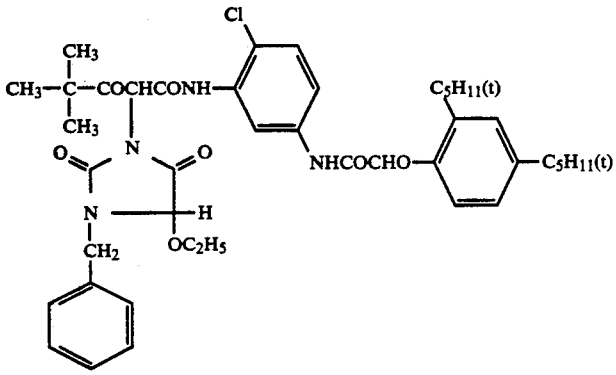
(Cpd-2)
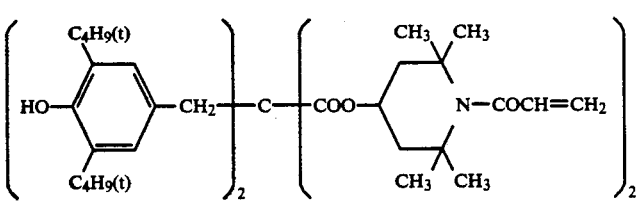
(Solv-1)
Mixture (1/1, by volume) of the following compounds:
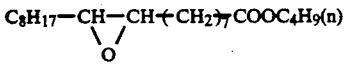
$O{=}P(OC_9H_{19}(iso))_3$
(Cpd-3)
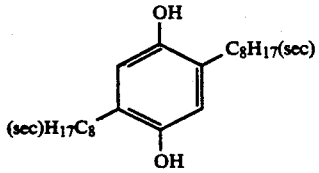
(Sen-2-1)
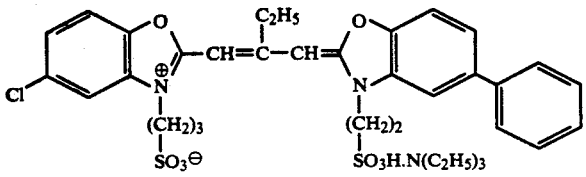
(Sen-2-2)
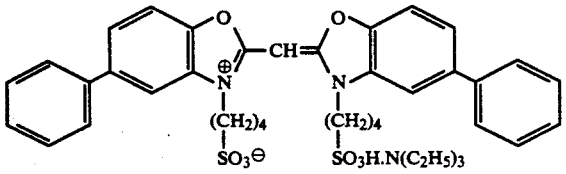

-continued
(Cpd-4)
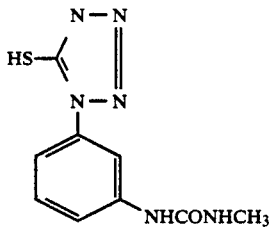
(ExM)
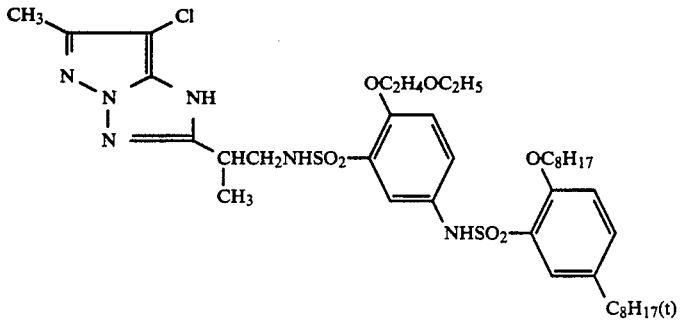
(Cpd-5)
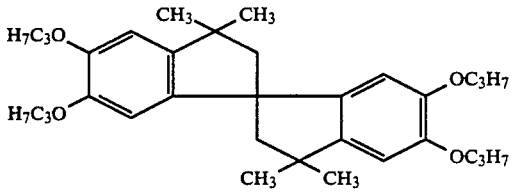
(Solv-2) Mixture (2/1, by volume) of the following compounds:
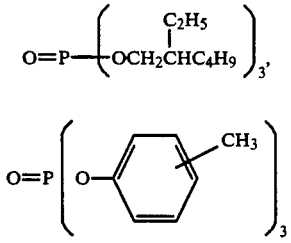
Mixture (UV) Mixture (by mole) of the following compounds:
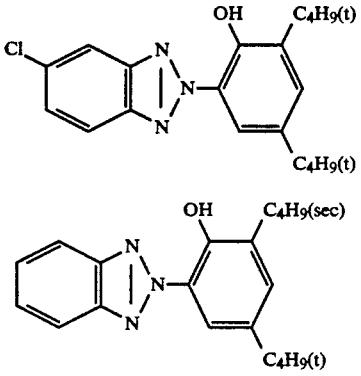
-continued
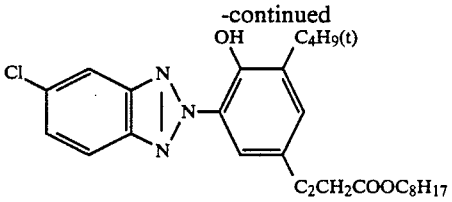
(Cpd-6)
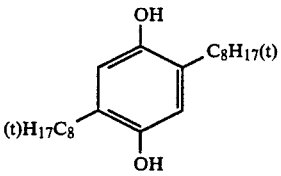
(Solv-3)
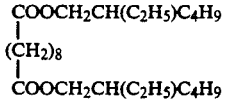
(Sen-3)
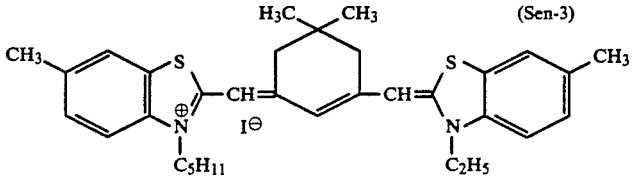
(Cpd-7)
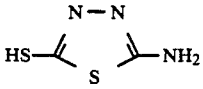

-continued (ExC)

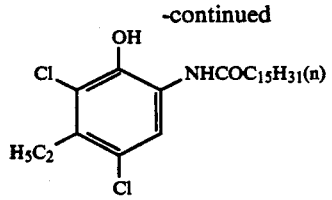

(Cpd-8)

Mixutre (1/3/3, by mole) of the following compounds:

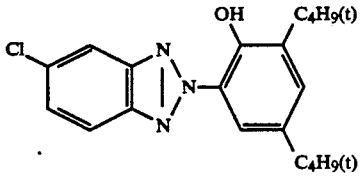

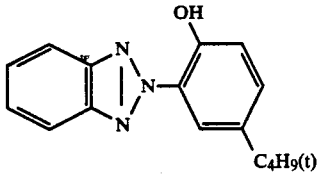

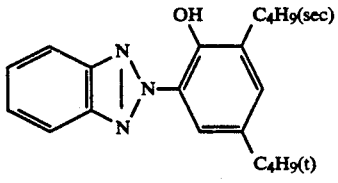

-continued (Cpd-9)

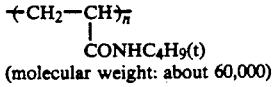

(molecular weight: about 60,000)

(Solv-4)

Mixture (1/1, by volume) of the following compounds:

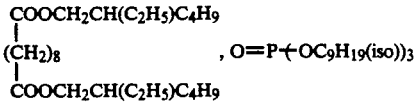

In the above-mentioned layer constitution, the dye in the fourth layer and the hardening agent in the sixth layer was varied as indicated in Table 1 below. Samples (1) to (7) were prepared therefrom. The hardening agent which falls within the scope of the present invention was used in the form of an aqueous solution containing the agent dissolved in water; while the hardening agent for comparison was dissolved in acetone and used.

TABLE 1

| | Dye (4th Layer) | | Hardening Agent (6th Layer) | |
|---|---|---|---|---|
| Sample No. | Kind | Amount Added | Kind | Amount Added |
| 1 (comparison) | A-1 | $2 \times 10^{-5}$ mol/ $m^2$ | H-1 | 0.15 mg/$m^2$ |
| 2 (comparison) | " | " | II-1 | 0.075 mg/$m^2$ |
| 3 (comparison) | I-5 | " | H-1 | 0.15 mg/$m^2$ |
| 4 (the present invention) | " | " | II-1 | 0.075 mg/$m^2$ |
| 5 (the present invention) | " | " | II-2 | 0.15 mg/$m^2$ |
| 6 (the present invention) | I-8 | " | " | 0.15 mg/$m^2$ |
| 7 (the present invention) | I-5, I-8 (1:1) | " | II-1 | 0.075 mg/$m^2$ |

(Comparative Dye A-1

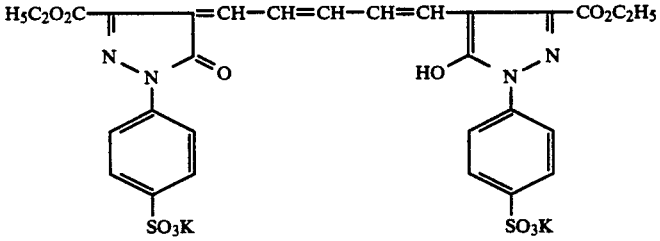

(Comparative Hardening Agent H-1)

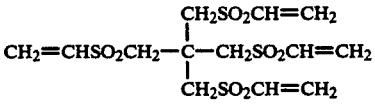

Samples (1) to (7) prepared were evaluated with respect to the followings:

(1) Moisture-dependency in Exposure

Each sample was exposed under the condition of 25° C. and 55% relative humidity, and 25° C. and 85% relative humidity. The exposed sample was photographically processed as mentioned below. The relative sensitivity at the optical density of 1.0 was evaluated for the bluesensitive layer, which might widely vary in accordance with the moisture condition variation. The moisturedependency is negligible with preferred as the difference (the absolute value) in relative sensitivity as to exposure under the condition of 25° C. and 55% relative humidity, and 25° C. and 85% relative humidity is smaller.

(2) Variation of Fog in Sample Stored

Each sample was stored under the condition of 28° C. and 60% relative humidity for one month and then photographically processed as mentioned below. The variation of fog in the stored sample was evaluated for the blue-sensitive layer, which might be large before and after storage.

| Processing Steps | Temperature | Time |
|---|---|---|
| Color Development | 33° C. | 3 min 30 sec |
| Bleach-fixation | 33° C. | 1 min 30 sec |
| Rinsing in Water | 24 to 34° C. | 3 min |
| Drying | 70 to 80° C. | 1 min |

The processing solutions used in the respective steps are as follows:

| | |
|---|---|
| Color Developer: | |
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-ethyl-N-(β-methanesulfonamidoethyl)-3-methyl-4-aminoaniline Sulfate | 5.0 g |
| Hydroxylamine Sulfate | 4.0 g |
| 4,4'-Diaminostilbene Series Brightening Agent (WHITEX 4B, manufactured by Sumitomo Chemical) | 1.0 g |
| Water to make | 1000 ml |
| pH (25° C.) | 10.20 |
| Bleach-fixing Solution: | |
| Water | 400 ml |
| Ammonium Thiosulfate (70%) | 150 ml |
| Sodium Sulfite | 18 g |
| Ammonium Ethylenediaminetetraacetato Ferrate | 55 g |
| Disodium Ethylenediaminetetraacetate | 5 g |
| Water to make | 1000 ml |
| pH (25° C.) | 6.70 |

The results obtained were shown in Table 2 below.

TABLE 2

| Sample No. | Relative Sensitivity (25° C. 55%) | Difference in Relative Sensitivity (25° C. 85%)-(25° C. 55%) | Variation of Fog After Storage |
|---|---|---|---|
| 1 (comparison) | 100 | −26 | +0.015 |
| 2 (comparison) | 102 | −25 | +0.006 |
| 3 (comparison) | 110 | −15 | +0.014 |
| 4 (the present invention) | 110 | −13 | +0.004 |
| 5 (the present invention) | 107 | −12 | +0.003 |
| 6 (the present invention) | 105 | −14 | +0.004 |
| 7 (the present invention) | 107 | −13 | +0.003 |

As is obvious from the results shown in Table 2 above, Samples (4) to (7) of the present invention were excellent as having both negligible moisture-dependency in exposure and negligible variation of fog after storage.

EXAMPLE 2

The same Samples (1) to (7) as those used in Example 1 were photographically processed in accordance with the procedure mentioned below. The processed samples were also evaluated by the same methods as in Example 1.

| Processing Steps | Temperature | Time |
|---|---|---|
| Color Development | 38° C. | 1 min 40 sec |
| Bleach-fixation | 35° C. | 60 sec |
| Rinsing (1) | 33 to 35° C. | 20 sec |
| Rinsing (2) | 33 to 35° C. | 20 sec |
| Rinsing (3) | 33 to 35° C. | 20 sec |
| Drying | 70 to 80° C. | 50 sec |

The processing solutions used in the respective steps are as follows.

| | |
|---|---|
| Color Developer: | |
| Water | 800 ml |
| Diethylenetriaminepentaacetic Acid | 1.0 g |
| Nitrilotriacetic Acid | 2.0 g |
| 1-Hydroxyethylidene-1, 1-diphosphonic Acid | 2.0 g |
| Benzyl Alcohol | 16 ml |
| Diethylene Glycol | 10 ml |
| Sodium Sulfite | 2.0 g |
| Potassium Bromide | 0.5 g |
| Potassium Carbonate | 30 g |
| N-ethyl-N-(β-methanesulfonamidoethyl)-3-methyl-4-aminoaniline Sulfate | 5.5 g |
| Hydroxylamine Sulfate | 2.0 g |
| Brightening Agent (WHITEX 4B, manufactured by Sumitomo Chemical) | 1.5 g |
| Water to make | 1000 ml |
| pH (25° C.) | 10.20 |
| Bleach-fixing Solution: | |
| Water | 400 ml |
| Ammonium Thiosulfate (70%) | 80 ml |
| Ammonium Sulfite | 24 g |
| Ammonium Ethylenediaminetetraacetato Ferrate | 30 g |
| Disodium Ethylenediaminetetraacetate | 5 g |
| Water to make | 1000 ml |
| pH (25° C.) | 6.50 |
| Rinsing Solution | |
| Ion-exchanged Water (Calcium, Magnesium: each 3 ppm or less). | |

The results obtained were shown in Table 3 below.

TABLE 3

| Sample No. | Relative Sensitivity (25° C. 55%) | Difference in Relative Sensitivity (25° C. 85%)-(25° C. 55%) | Variation of Fog After Storage |
|---|---|---|---|
| 1 (comparison) | 100 | −27 | +0.015 |
| 2 (comparison) | 105 | −25 | +0.005 |
| 3 (comparison) | 110 | −14 | +0.015 |

TABLE 3-continued

| Sample No. | Relative Sensitivity (25° C. 55%) | Difference in Relative Sensitivity (25° C. 85%)-(25° C. 55%) | Variation of Fog After Storage |
|---|---|---|---|
| 4 (the present invention) | 110 | −13 | +0.004 |
| 5 (the present invention) | 107 | −13 | +0.004 |
| 6 (the present invention) | 107 | −14 | +0.003 |
| 7 (the present invention) | 107 | −12 | +0.003 |

As is obvious from the results shown in Table 3 above, Samples (4) to (7) of the present invention were excellent as having both a negligible moisture-dependency in exposure and a negligible elevation of fog after storage, like the aforesaid Example 1.

EXAMPLE 3

Samples (8) to (13) were prepared in the same manner as in Example 1, except that the silver halide emulsions in the first, third and fifth layers, the dye in the fourth layer and the hardening agent in the sixth layer were varied as indicated in Table 4 below. In preparation of these samples, the spectral sensitizing agents were added to the silver halide emulsions prior to chemical sensitization.

The emulsions shown in Table 4 below are as follows:

Em-1: Monodisperse cubic silver chlorobromide emulsion (silver bromide 1 mol %; mean grain size 0.96 μm; coefficient of variation 9.2%).

Em-2: Monodisperse cubic silver chlorobromide emulsion (silver bromide 1 mol %; mean grain size 0.54 μm; coefficient of variation 10.0%.)

Em-3: Monodisperse cubic silver chlorobromide emulsion (silver bromide 1 mol %; mean grain size 0.55 μm; coefficient of variation 10.3%.)

TABLE 4

| Sample No. | Silver Halide Emulsion | Dye (4th Layer) | | Hardening Agent (6th Layer) | | |
|---|---|---|---|---|---|---|
| 8 (comparison) | 1st Layer; Em-1<br>3rd Layer; Em-2<br>5th Layer; Em-3 | A-1, A-2<br>(1:1) | mol/m$^2$<br>$2 \times 10^{-5}$ | H-1 | 0.17 | g/m$^2$ |
| 9 (comparison) | 1st Layer; Em-1<br>3rd Layer; Em-2<br>5th Layer; Em-3 | A-1, A-2<br>(1:1) | mol/m$^2$<br>$2 \times 10^{-5}$ | II-1 | 0.085 | g/m$^2$ |
| 10 (comparison) | 1st Layer; Em-1<br>3rd Layer; Em-2<br>5th Layer; Em-3 | I-37, I-10<br>(1:1) | mol/m$^2$<br>$2 \times 10^{-5}$ | H-1 | 0.17 | g/m$^2$ |
| 11 (the present invention) | 1st Layer; Em-1<br>3rd Layer; Em-2<br>5th Layer; Em-3 | I-37, I-10<br>(1:1) | mol/m$^2$<br>$2 \times 10^{-5}$ | II-1 | 0.085 | g/m$^2$ |
| 12 (the present invention) | 1st Layer; Em-1<br>3rd Layer; Em-2<br>5th Layer; Em-3 | I-37, I-10<br>(1:1) | mol/m$^2$<br>$2 \times 10^{-5}$ | II-2 | 0.17 | g/m$^2$ |
| 13 (the present invention) | 1st Layer; Em-1<br>3rd Layer; Em-2<br>5th Layer; Em-3 | I-16, I-8<br>(1:1) | mol/m$^2$<br>$2 \times 10^{-5}$ | II-1 | 0.085 | g/m$^2$ |

(Comparative Dye A-2)

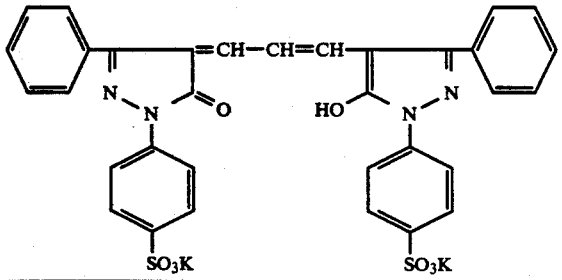

These samples were photographically processed in accordance with the procedure mentioned below, and the processed samples were evaluated in the same manner as in Example 1.

| Processing Steps | Temperature | Time |
|---|---|---|
| Color Development | 35° C. | 45 sec |
| Bleach-fixation | 30 to 35° C. | 45 sec |
| Rinsing (1) | 30 to 35° C. | 20 sec |
| Rinsing (2) | 30 to 35° C. | 20 sec |
| Rinsing (3) | 30 to 35° C. | 20 sec |
| Rinsing (4) | 30 to 35° C. | 30 sec |
| Drying | 70 to 80° C. | 60 sec |

(The rinsing was carried out under countercurrent system from the fourth rinsing tank (4) to the first rinsing tank (1).)

The processing solutions used in the respective steps were as follows.

| Color Developer: | |
|---|---|
| Water | 800 ml |
| Ethylenenediamine-N,N,N',N'-tetramethylenephosphonic Acid | 1.5 g |
| Triethylenediamine(1,4-diazabicyclo[2,2,2]octane) | 5.0 g |
| Sodium Chloride | 1.4 g |
| Potassium Carbonate | 25 g |
| N-ethyl-N-(β-methanesulfonamidoethyl)-3-methyl-4-aminoaniline Sulfate | 5.0 g |
| N,N-diethylhydroxylamine | 4.2 g |

-continued

| | |
|---|---|
| 4,4'-Diaminostilbene Series Brightening Agent (UVITEX CK, manufactured by Ciba-Geigy) | 2.0 g |
| Water to make | 1000 ml |
| pH (25° C.) | 10.10 |
| Bleach-fixing Solution: | |
| Water | 400 ml |
| Ammonium Thiosulfate (70%) | 100 ml |
| Sodium Sulfite | 18 g |
| Ammonium Ethylenediaminetetraacetato Ferrate | 55 g |
| Disodium Ethylenediaminetetraacetate | 3 g |
| Ammonium Bromide | 40 g |
| Glacial Acetic Acid | 8 g |
| Water to make | 1000 ml |
| pH (25° C.) | 5.5 |
| Rinsing Solution: | |
| Ion-exchanged Water (Calcium, Magnesium: each 3 ppm or less). | |

The results obtained were shown in Table 5 below. As is obvious from the result, Samples (11) to (13) of the present invention were excellent as having both a negligible moisture-dependency in exposure and a negligible elevation of fog after storage.

TABLE 5

| Sample No. | Relative Sensitivity (25° C. 55%) | Difference in Relative Sensitivity (25° C. 85%)-(25° C. 55%) | Variation of Fog After Storage |
|---|---|---|---|
| 8 (comparison) | 100 | −21 | +0.020 |
| 9 (comparison) | 105 | −22 | +0.005 |
| 10 (comparison) | 105 | −11 | +0.018 |
| 11 (the present invention) | 110 | −10 | +0.004 |
| 12 (the present invention) | 110 | −10 | +0.003 |
| 13 (the present invention) | 105 | −9 | +0.004 |

In accordance with the present invention, there has been provided a silver halide photographic material having a hydrophilic colloid layer containing a novel dye which is decolored by photographic processing and which does not have any bad influence on the photographic characteristics of the photographic emulsion, especially on the spectral sensitizability thereof.

In accordance with the present invention, there has also been provided a silver halide photographic material which is excellent in the time-dependent stability and which has a negligible moisture-dependency in exposure.

While the invention has been described in detail and with reference to specific embodiments thereof, it will be apparent to one skilled in the art that various changes and modifications can be made therein without departing from the spirit and scope thereof.

What is claimed is:

1. A gelatino-silver halide photographic material comprising at least one light-sensitive silver halide emulsion layer and at least one non-emulsion auxiliary photographic layer provided on a support, wherein at least one of said layers comprises a compound represented by formula (I) and at least one hardener selected from the group consisting of compounds of formula (II) and formula (III);

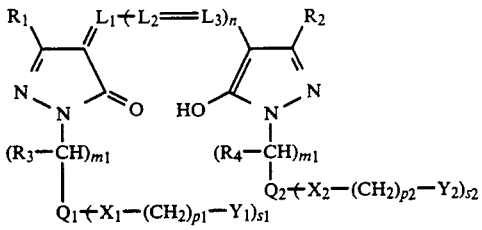

(I)

where $R_1$ and $R_2$ each independently represents $-COOR_5$ or

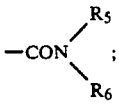

$R_3$ and $R_4$ each independently represents a hydrogen atom or an alkyl group;

$R_5$ and $R_6$ each independently represents a hydrogen atom, an alkyl group or an aryl group or together a 5-membered or 6-membered ring;

$Q_1$ and $Q_2$ each independently represents an aryl group; $X_1$ and $X_2$ each independently represents a divalent linking group or a bond;

$Y_1$ and $Y_2$ each independently represents a sulfo group or a carboxyl group;

$L_1$, $L_2$ and $L_3$ each independently represents a methine group;

$m_1$ and $m_2$ each independently represents 1 or 2;

n represents 0, 1 or 2;

$p_1$ and $p_2$ each independently represents 0, 1, 2, 3 or 4; and $s_1$ and $s_2$ each independently represents 1 or 2;

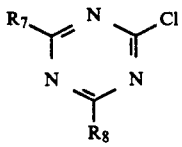

(II)

where $R_7$ represents a chlorine atom, a hydroxyl group, an alkyl group, an alkoxy group, an alkylthio group, —OM in which M is a monovalent metal atom, $-NR^IR^{II}$ or $-NHCOR^{III}$ wherein $R^I$, $R^{II}$ and $R^{III}$ are each independently a hydrogen atom, an alkyl group or an aryl group; and $R_8$ has the same meaning as $R_7$ except that it does not represent a chlorine atom;

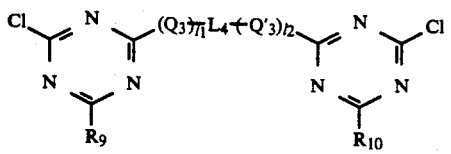

(III)

where $R_9$ and $R_{10}$ each independently represents a chlorine atom, a hydroxyl group, an alkyl group, an alkoxy group or -OM in which M is a monovalent metal atom;

$Q_3$ and $Q_3'$ each independently represents a linking group represented by —O—, —S— or —NH—;

$L_4$ represents an alkylene group or an arylene group; and $l_1$ and $l_2$ each independently represents 0 or 1.

2. A gelatino-silver halide photographic material as in claim 1, wherein $R_3$ and $R_4$ independently represents a hydrogen atom or a methyl group, $R_5$ and $R_6$ independently represents a hydrogen atom, an alkyl group having 1 to 4 carbon atoms, a substituted alkyl group having 1 to 6 carbon atoms, a phenyl group or a substituted phenyl group, or $R_5$ and $R_6$ together from a 5-membered or 6-membered ring; $Q_1$ and $Q_2$ independently represents a phenyl group or a substituted phenyl group, $X_1$ and $X_2$ independently represents —O—, —$NR'_7$— wherein $R'_7$, is a hydrogen atom, an alkyl group having 1 to 5 carbon atoms or a substituted alkyl group having 1 to 5 carbon atoms, or a bond.

3. A gelatino-silver halide photographic material as in claim 1, wherein $m_1$ and $m_2$ each is equal to 1.

4. A gelatino-silver halide photographic material as in claim 1, wherein said at least one compound selected from the group consisting of formula (II) and formula (III) is present in at least one or more layers selected from said emulsion layer and said auxiliary layers in an amount of from 1 to 100 mg per g of gelatin.

5. A gelatino-silver halide photographic material as in claim 1, wherein the silver halide emulsion layer contains monodisperse silver halide grains having a cubic or tetradecahedral shape and a coefficient of variation of grain size of 0.2 or less.

6. A gelatino-silver halide photographic material as in claim 5, wherein the coefficient of variation is 0.15 or less.

7. A gelatino-silver halide photographic material as in claim 6, wherein the coefficient of variation is 0.10 or less.

8. A gelatino-silver halide photographic material as in claim 5, wherein the silver halide emulsion layer contains monodisperse silver chlorobromide grains having a silver chloride content of from 90 to 99.8 mol % and a cubic or tetradecahedral shape and a coefficient of variation of grain size of 0.2 or less.

* * * * *